US006925909B2

(12) United States Patent
Crosby et al.

(10) Patent No.: US 6,925,909 B2
(45) Date of Patent: Aug. 9, 2005

(54) FASTENER HOLDING DEVICE

(76) Inventors: Robert J. Crosby, 1262 Evergreen Dr., Bridgewater, NJ (US) 08807; John V. Jaunarajs, 101 Pulaski Rd., Whitehouse Station, NJ (US) 08889

( * ) Notice: Subject to any disclaimer, the term of this patent is extended or adjusted under 35 U.S.C. 154(b) by 0 days.

(21) Appl. No.: 10/680,936

(22) Filed: Oct. 8, 2003

(65) Prior Publication Data

US 2005/0076743 A1 Apr. 14, 2005

(51) Int. Cl.[7] ..... B25B 27/14
(52) U.S. Cl. ..... 81/44
(58) Field of Search ..... 81/44, 13, 6, 7, 81/3.8, 186, 488

(56) References Cited

U.S. PATENT DOCUMENTS

| | | | | | |
|---|---|---|---|---|---|
| 2,722,148 | A | * | 11/1955 | Woyton | 294/99.2 |
| 3,060,442 | A | * | 10/1962 | Tomek | 81/44 |
| 4,256,157 | A | | 3/1981 | Grayson | |
| 4,581,962 | A | | 4/1986 | Marbourg | |
| 4,736,658 | A | | 4/1988 | Jore | |
| 4,841,819 | A | * | 6/1989 | Williams | 81/3.8 |
| 4,843,923 | A | * | 7/1989 | Voss | 81/44 |
| 4,862,774 | A | | 9/1989 | Else et al. | |
| 5,515,755 | A | | 5/1996 | Kung | |
| 2003/0110900 | A1 | * | 6/2003 | Chen | 81/44 |

* cited by examiner

*Primary Examiner*—Jacob K. Ackun, Jr.
(74) *Attorney, Agent, or Firm*—Kenneth P. Glynn

(57) ABSTRACT

The present invention is a device for holding a fastener for fastening or unfastening of said fastener. It includes an elongated member having a central portion, the central portion being a handle, and having a first and second end. The elongated member has a central axis. The first end of the elongated member has a first pair of gripping fingers substantially parallel with the central axis, and the second end has a second pair of gripping fingers substantially non-parallel with the central axis. The first pair of gripping fingers and the second pair of gripping fingers each have opposing fingers with non-straight inside opposing surfaces, and include a biasing spring that biases each gripping finger of each pair of gripping fingers toward one another. The first pair of gripping fingers and the second pair of gripping fingers are adapted to removably retain a fastener.

20 Claims, 3 Drawing Sheets

FASTENER HOLDING DEVICE

REFERENCE TO RELATED APPLICATION

This application is based on Provisional Application Ser. No. 60/417,510, filed in the United States Patent Office on Oct. 10, 2002 by the same inventors herein and entitled "Fastener Holding Device" and priority is claimed based on said provisional application.

BACKGROUND OF THE INVENTION

1. Field of the Invention

The present invention relates to a unique device for grasping fasteners, fastener accessories, and other small or difficult to hold or reach objects. It is essentially an elongated handle with pairs of gripping fingers at opposite ends. The gripping fingers are biased towards one another so as to create tension when items are being held by the device.

2. Information Disclosure Statement

The following patents are representative of the art relating to fastener holding devices:

U.S. Pat. No. 4,256;157 discloses a nut, bolt and screw holder arrangeable on a finger of a user of the holder, which has a support arrangement disposed for engaging with a finger of the user along a longitudinal extent of the finger. A holding assembly is mounted on the support arrangement for selectively engaging an item, or items, to be held and retaining the item on the support arrangement. The support arrangement includes a longitudinal extending member, and a finger engaging structure provided on the member for cooperatively engaging with as associated finger and removably retaining the member on the finger. The longitudinally extending member includes a first end and a second end spaced from the first end, with the holding arrangement being disposed on the member at the first end of the member. The finger engaging structure includes a ring pivotally mounted on the member adjacent the second end of the member, with the ring being arranged for receiving a finger on which the holder is to be mounted.

U.S. Pat. No. 4,581,962 describes an invention that is intended for use with threaded fasteners, screws, bolts and similar devices, in their almost limitless applications to assembling objects and structures. These fasteners exist in many types, each requiring a special tool bit. On many occasions screws or other fasteners must be installed or removed in locations difficult of access and of which clear view may not be obtained, also where use of two hands is not possible. This invention is particularly intended for these situations. The invention comprises basically a combination of a barrel and collar, preferably made of stiff but flexible plastic, which fit over and enclose a tool for threaded fasteners, either with a fixed bit or one which can accept insertable bits. The barrel provides at its working or tip end a set of flexible elements which act to grip screw heads and hold them registered with the tool. The barrel can be fixed in place on the tool shaft by a partial turn of either form of the collar. The collar works with a spring to move the barrel into gripping position. A variation for jewelers' screwdrivers uses a miniature barrel without a collar but with a spring.

U.S. Pat. No. 4,736,658 describes an invention that is intended as an improved screw holding and driving device having a sleeve positioned on a shank of a screwdriver in surrounding relation. The interior diameter of the sleeve being sized to permit slidable rotation of the sleeve with respect to the shank. The sleeve having a ball detent device for cooperating with a groove located on the screwdriver shank to hold the sleeve in a position on the shank where the sleeve does not extend beyond the screwdriver bit. The ball detent device when engaging the groove enables the sleeve to be held in the position where the sleeve will not be used to hold a screw and at the same time permit the sleeve to be freely rotatable on the shank of the screwdriver.

U.S. Pat. No. 4,862,774 discloses a screwholder device comprising jaws which form two halves of an axial passageway down which a screw is driven. The jaws are hinged at the rearmost end and resiliently held together by a narrowing at the front exit ends. The screw is driven down the passageway and is held by the jaw ends while being driven to a certain extent into a surface, and the screwhead pushes the jaws apart to allow the screw to exit from the device during final securement of the screw.

U.S. Pat. No. 5,515,755 describes an invention that is intended as an insulated fastener retainer, which includes an oval sleeve and oval ring coupled by a plurality of connectors and supporting a pair of oppositely positioned elongated beams. The beams are secured to the flat sides of the oval ring at one end and are received within insulating blocks at the outer ends. A pair of resilient jaws having grip portions are coupled to the insulating blocks and are movable in response to movement of the elongated beams. The fastener retainer is received upon a screwdriver shaft and is maintained thereon by the oval sleeve. The elongated beams and jaws are oval ring thereby distorting the oval ring and separating the fastener retainer jaws.

Notwithstanding the prior art, the present invention is neither taught nor rendered obvious thereby.

SUMMARY OF THE INVENTION

The present invention is a device for holding a fastener for fastening or unfastening of said fastener. It includes an elongated member having a central portion, the central portion being a handle, and the elongated member has a first end and second end. The elongated member has a central axis. The first end of the elongated member has a first pair of gripping fingers substantially parallel with the central axis, and the second end has a second pair of gripping fingers substantially non-parallel with the central axis. The first pair of gripping fingers and the second pair of gripping fingers each have opposing fingers with non-straight inside opposing surfaces, and include a biasing spring that biases each gripping finger of each pair of gripping fingers toward one another. The first pair of gripping fingers and the second pair of gripping fingers are adapted to removably retain a fastener. The inside opposing surface of at least one of the first pair of gripping fingers and the second pair of gripping fingers may be symmetric or asymmetric with respect to one another, each type bearing benefits for specific types of fasteners.

The biasing spring for the present invention device for holding a fastener may be established as a U-shaped member connected to each gripping finger of the first pair and/or the second pair of gripping fingers inserted into a hollow handle so that the spring tension and the retaining aspect of the handle work together to create a closed position bias. Alternatively, leaf springs or other springs could be used. Typically, one set of gripping fingers is about parallel to the central axis where the second pair of gripping fingers is at an angle between 40° and about 110° from the central axis, preferably about 80° to about 100° e.g. about 90° therefrom.

In some preferred embodiments, the central portion of the elongated member includes an insulated outer area, and may also have an insulted inner area.

In some preferred embodiments, the elongated member is at least partially hollow and one or both of the pairs of gripping fingers is slideably mounted therein so as to be moveable along the central axis.

BRIEF DESCRIPTION OF THE DRAWINGS

The present invention should be more filly understood when the specification herein is taken in conjunction with the drawings appended hereto wherein.

DETAILED DESCRIPTION OF THE PRESENT INVENTION

Figure 1:
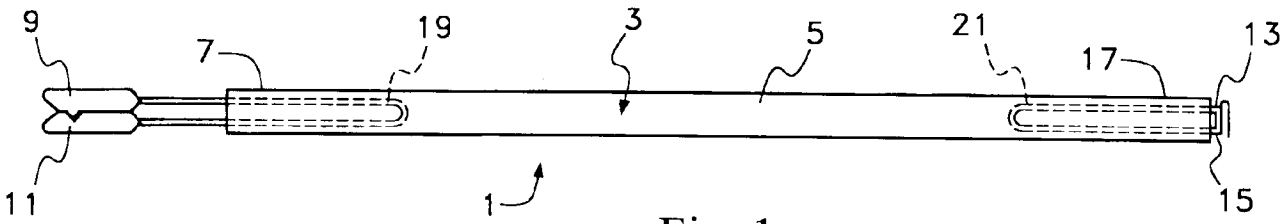
FIG. 1 shows a top view.

The present invention is a device for holding a fastener for fastening or unfastening of the fastener. By "fastener" is meant any fastener, including bolts, screws, e.g. slot screws, Phillips screws, or any other type of screws, eyelets, and the like, and accessories relating thereto, such as nuts, washers, spacers, and the like.

The present invention device includes an elongated member having a central portion, being a handle, and having a first end and a second end. The elongated member may be symmetrical or asymmetrical and has a central axis. The first end has a first pair of gripping fingers substantially parallel with the central axis, and the second end has a second pair of gripping fingers substantially non-parallel with the central axis. This second pair may be at any angle to the central axis, and in some preferred embodiments, the second pair of gripping fingers is at an angle between about 40° and about 110° from the central axis, preferably about 80° to about 100°.

The first pair of gripping fingers and said second pair of gripping fingers each having opposing fingers. These opposing fingers are preferably with non-straight inside opposing surfaces for ease of gripping the fastener.

The device also includes a biasing spring that biases each gripping finger of each pair of gripping fingers toward one another. Thus the first pair of gripping fingers and the second pair of gripping fingers are adapted to removably retain a fastener.

In preferred embodiments, the present invention device inside opposing surfaces of each pair of gripping fingers are symmetric relative to one another. In other embodiments, they are asymmetric. In these asymmetric embodiments the gripping fingers are irregular, offset and/or reversed relative to one another. For example, the inside opposing surfaces of a pair of gripping fingers may include one finger with a recess area and one opposing finger with a protrusion area. Preferably, the recess area is larger than the opposing protrusion area to enhance retention of a fastener.

The device biasing spring may be one or two separate spring pieces, or part of the fingers, for example, the spring may be established as a U-shaped member connected to each gripping finger of the first pair of gripping fingers and another for the second pair of gripping fingers.

The present invention central portion of the elongated member may include an insulated outer area, or the entire elongated portion may be made of insulative material(s). The elongated member may be a hollow member and the first pair of gripping fingers and the second pair of gripping fingers may be partially inserted therein.

The present invention device may be made of material selected from a group consisting of metal, plastic, fiberglass, glass, ceramic and combinations thereof. Preferred embodiments include the elongated member made of metal, plastic or fiberglass, and, when made of metal includes insulative plastic covering. The gripping fingers are preferably formed of flat stock material or round wire stock material and are also preferable plastic covered for insulation and to prevent scratching of components or devices being worked on.

By use of the present invention devices, fasteners and their accessories may conveniently be retained for attachment or removal, and items too small or difficult to hold, and difficult access usages, are now conveniently accomplished.

Figure 2:
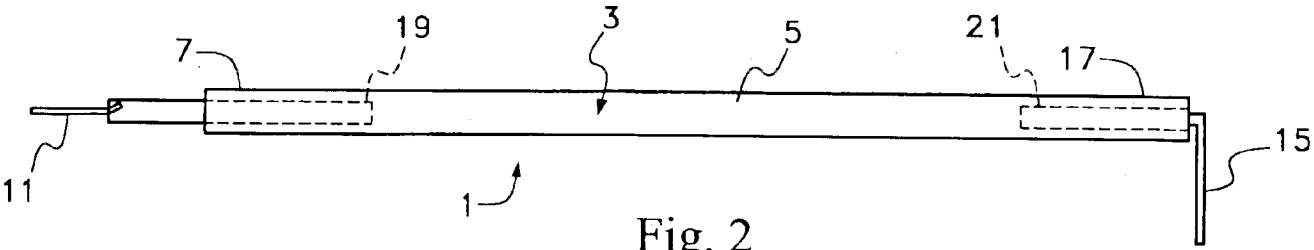
FIG. 2 shows a side view and FIG. 3 shows an end view of one embodiment of a present invention fastener holding device.
Figure 3:
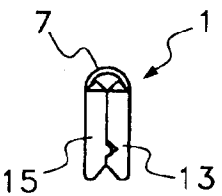
Figure 6:
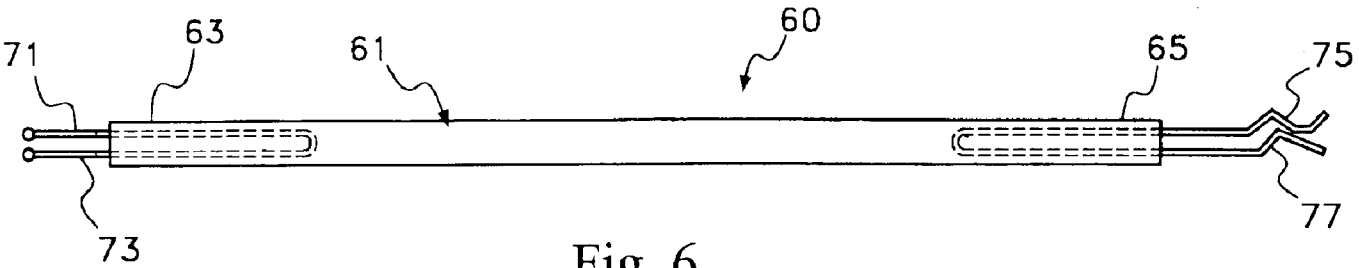
FIGS. 6, 7, 8 and 9 show another alternative embodiment present invention fastener holding device, in top, side, and cut end views.
Figure 7:
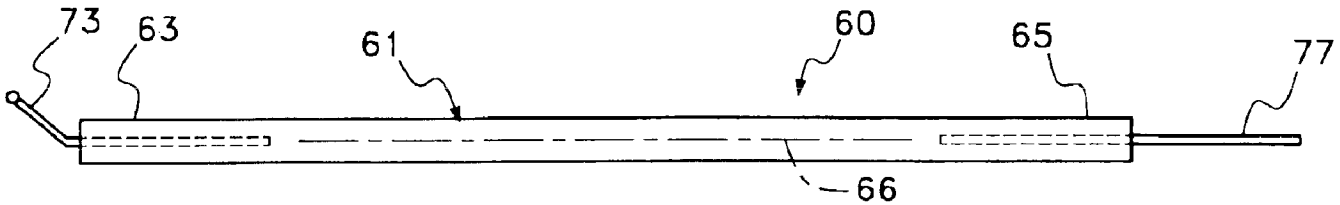

The present invention should be more fully understood when the specification herein is taken in conjunction with the drawings appended hereto wherein:

FIG. 1 shows a top view, FIG. 2 shows a side view and FIG. 3 shows an end view of one embodiment of the present invention device 1. It includes an elongated member 3 having a central portion 5 that acts as a handle. There is a first set of gripping fingers 9 and 11 at elongated member first end 7 and a second set of gripping fingers 13 and 15 at elongated member second end 17. Elongated member 3 has two hollow ends with the gripping fingers at opposite ends of a "hairpin" type member with a U-shaped innermost portion, which act, in conjunction with the retaining feature of the elongated member hollow end, as a spring to keep tension on the individual fingers to keep them together and to bias them towards one another.

Figure 4:
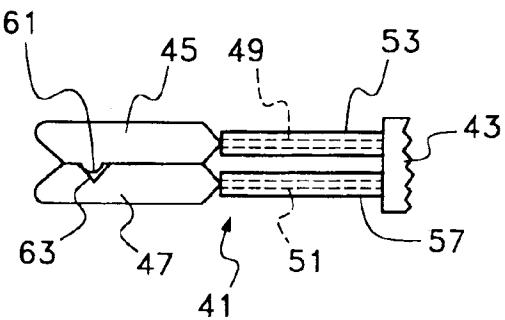
FIG. 4 shows a partial top view of a blown up version of another present invention &stener holding device.

FIG. 4 shows a blown-up version of a preferred embodiment of a present invention device 41 shown in a partial top view. There is shown a portion of an elongated member 43 with a pair of gripping fingers 45 and 47 extending outwardly therefrom via rods 49 and 51. These rods are insulated with plastic covers 53 and 57. There is an internal spring (not shown) that biases these items toward one another. Gripping finger 45 includes a small protrusion 61 and gripping finger 47 has a relatively large indentation or cutout 63. They are positioned on their gripping fingers so that protrusion 61 nests within a portion of cutout 63. Further, protrusion 61 is offset relative to cutout 63, that is, it is not on center. This enhances gripping as is illustrated in the discussion below with respect to FIG. 5.

Figure 5:
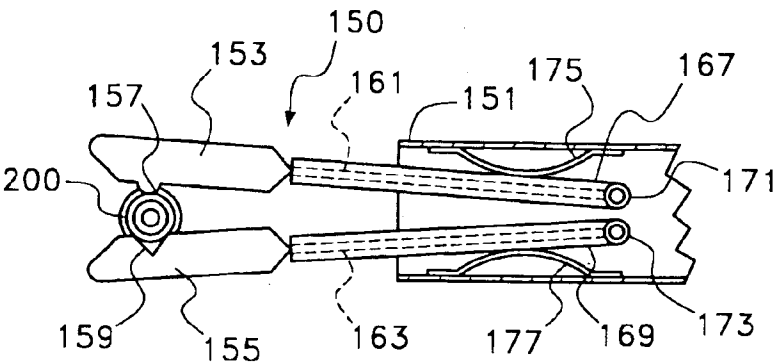
FIG. 5 shows a partial, cut top view of another present invention fastener holding device, shown holding a screw.

Referring specifically to FIG. 5, there is shown a partial cut view of another embodiment present invention device 150. This includes a hollow, rectangular, elongated member 151, with gripping fingers 153 and 155 connected via arms 161 and 163 to elongated member 151 at hinge points 171 and 173. The arms 161 and 163 are protected with insulative coatings 167 and 169, and are biased toward one another by leaf springs 175 and 177. The gripping fingers 153 and 155 are holding screw 200, as shown. For example, when a screw is being unscrewed and has been partially unscrewed, flat gripping fingers 1-53 and 155 slide in and grip the screw. As the screw is further unscrewed and then fully unscrewed the gripping fingers retain the screw.

Figure 9:
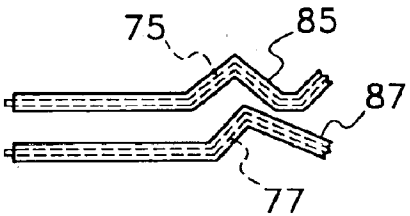
Figure 8:
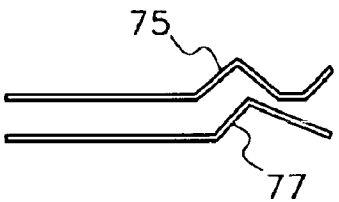

FIGS. 6, 7, 8, and 9 show an alternative embodiment present invention device 60. Elongated member 61 has opposing ends 63 and 65 with metal wire stock pairs of gripping fingers. First pair of gripping fingers 71 and 73 are positioned in a non-parallel arrangement relative to central axis 66 while opposite end second pair of gripping fingers 75 and 77 are parallel to central axis 66 FIG. 8 shows the offset, asymmetric profiles of gripping fingers 75 and 77, and FIG. 9 shows them with insulative covers 85 and 87. Device 60 may be used in the same fashion as devices 1 and 150 described above.

Figure 10:
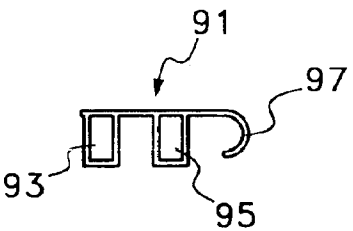
FIG. 10 shows an accessory for present invention fastener holding devices, namely, an electrical lug retainer.

FIG. 10 shows a present invention device accessory, namely, and electrical lug retainer 91. This includes two rigid loops 93 and 95 adapted to slide onto an end of a present invention device, such as end 17 of device 1 shown in FIGS. 1 and 2. Rounded hook 97 would rest below fingers 13 and 15 to retain an electrical lug while fingers 13 and 15 held an attachment screw so that a user may screw an electrical lug to a base without the need for tweezers, tape, glue or magnets in otherwise difficult area to reach.

Figure 13:
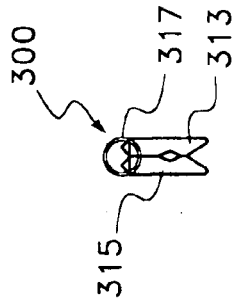
FIGS. 11, 12 and 13 show atop, side and end view, respectively, of another present invention fastener holding device; and, FIG. 14 shows a partial top view
Figure 11:
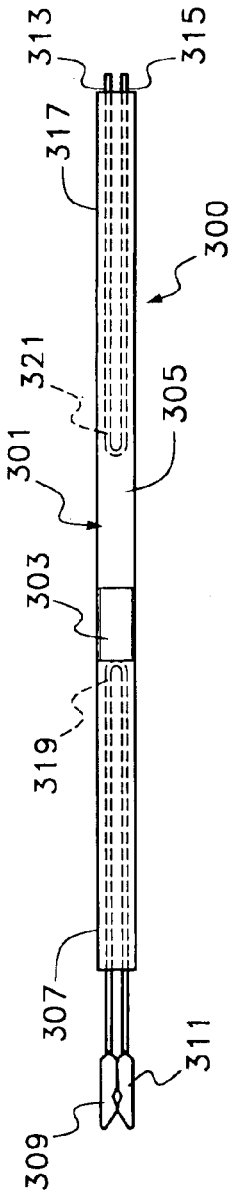
Figure 12:
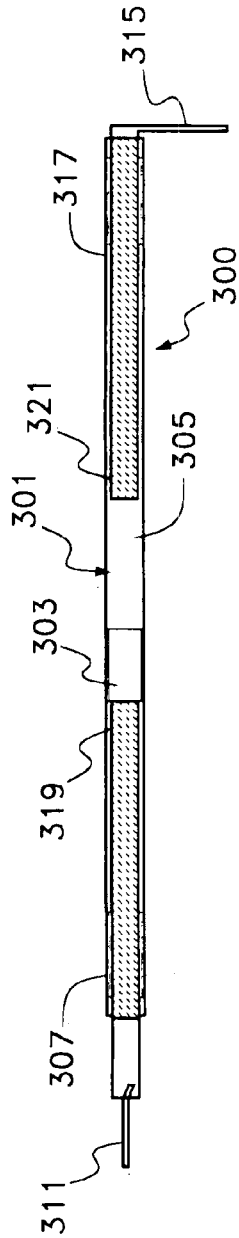

FIG. 11 shows a top view, FIG. 12 shows a side view and FIG. 13 shows an end view of one embodiment of the present invention device 300. It includes an elongated member 301 having a central portion 305 that acts as a handle. This elongated member 301 is hollow and has a block 303 in its central portion 305 to act as a stop for the telescoping pairs of gripping fingers. Block 303 could be plastic, metal or other material, and, in some embodiments, could be insulative to eliminate possible shocking and/or shorting. There is a first set of gripping fingers 309 and 311 at elongated member first end 307 and a second set of gripping fingers 313 and 315 at elongated member second end 317. Elongated member 301 has two hollow ends with the gripping fingers are at opposite ends of a "hairpin" type member with a U-shaped innermost portion, which acts, in conjunction with the retaining feature of the elongated member hollow end, as a spring to keep tension on the individual fingers to keep them together and to bias them towards one another.

The first set of gripping fingers 309 and 311, as well as the second set of gripping fingers 313 and 315 one telescopically mounted within the hollow ends of elongated member 301, to provide extended components when needed. Stop 325 and 327 prevent removal of the gripping fingers from the elongated member.

Figure 14:
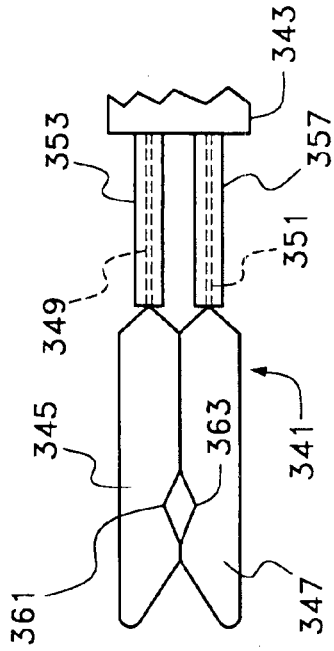

FIG. 14 shows a blown-up version of a preferred embodiment of a present invention device 341 shown in a partial top view. There is shown a portion of an elongated member 343 with a pair of gripping fingers 345 and 347 extending outwardly therefrom via rods 349 and 351. These rods are insulated with plastic covers 353 and 357. There is an internal spring (not shown) that biases these items toward one another. Gripping fingers 345 and gripping finger 347 have relatively large indentations or cutouts 361 and 363, respectively for holding a fastener. This enhances gripping as is illustrated in the discussion below with respect to FIG. 15.

Figure 15:
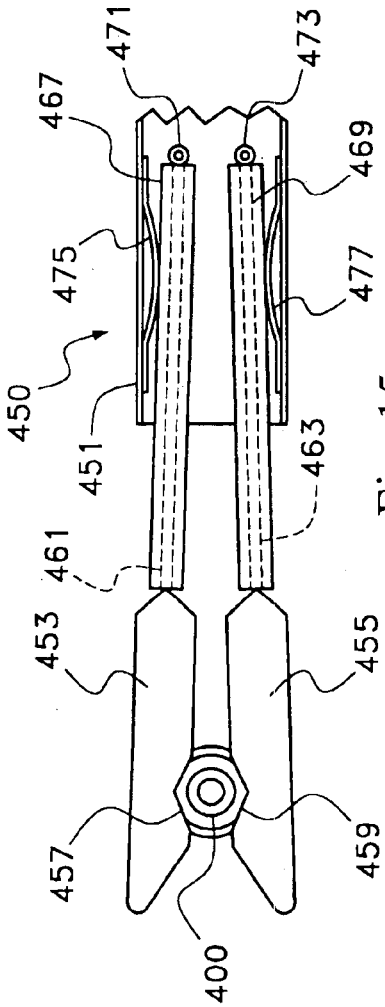
FIG. 15 shows that view with a screw being held, of another present invention fastener holding device.

Referring specifically to FIG. 15, there is shown a partial cut view of another embodiment present invention device 450. This includes a hollow, rectangular, elongated member 451, with gripping fingers 453 and 455 connected via arms 461 and 463 to elongated member 451 at hinge points 471 and 473. The arms 461 and 463 are protected with insulative coatings 467 and 169, and are biased toward one another by leaf springs 475 and 477. The gripping fingers 453 and 455 are holding screw 400, as shown. For example, when a screw is being unscrewed and has been partially unscrewed, flat gripping fingers 453 and 455 slide in and grip the screw. As the screw is further unscrewed and then fully unscrewed the gripping fingers retain the screw.

Obviously, numerous modifications and variations of the present invention are possible in light of the above teachings. For example, the exact shapes and sizes of present invention devices may vary significantly, from the microscopic to the relatively large size gripping fingers. The device could be made to accommodate half-inch wide fasteners. The handle portion could be symmetric or non-symmetric, and could be bulbous or otherwise ergonomic. It is therefore understood that within the scope of the appended claims, the invention may be practiced otherwise than as specifically described herein.

What is claimed is:

1. A device for holding a fastener for fastening or unfastening of said fastener, which comprises:

an elongated member having a central portion, said central portion being a handle, and having a first end and a second end, said elongated member having a central axis, said first end having a first pair of gripping fingers substantially parallel with said central axis, and said second end having a second pair of gripping fingers substantially non-parallel with said central axis, said first pair of gripping fingers and said second pair of gripping fingers each having opposing fingers with non-straight inside opposing surfaces, and including a biasing spring that biases each gripping finger of each pair of gripping fingers toward one another, said first pair of gripping fingers and said second pair of gripping fingers being adapted to removably retain a fastener.

2. The device for holding fastener of claim 1 wherein said inside opposing surface of at least one of said first pair of gripping fingers and said second pair of gripping fingers are symmetric with respect to one another.

3. The device for holding a fastener of claim 1 wherein said inside opposing surfaces of said first pair of gripping fingers and of said second pair of gripping fingers are asymmetric relative to one another.

4. The device for holding a fastener of claim 3 wherein said inside opposing surfaces of said first pair of gripping fingers and of said second pair of gripping fingers include one recess area and one opposing protrusion area.

5. The device for holding a fastener of claim 4 wherein said recess area is larger than said opposing protrusion.

6. The device for holding a fastener of claim 1 wherein said biasing spring is established as a U-shaped member connected to each gripping finger of said first pair of gripping fingers.

7. The device for holding a fastener of claim 1 wherein mid biasing spring is a plurality of leaf springs, at least one of said plurality of leaf springs set against each of said gripping fingers.

8. The device for holding a fastener of claim 1 wherein said second pair of gripping fingers is at an angle between about 40° and about 110° from said central axis.

9. The device for holding a fastener of claim 8 wherein said second pair of gripping fingers is at an angel between 80 degrees and about 100 degrees from said central axis.

10. The device for holding a fastener of claim 1 wherein said central portion of said elongated member includes an insulated outer area.

11. The device for holding a fastener of claim 10 wherein said elongated member is a hollow member and said first pair of gripping fingers and said second pair of gripping fingers are partially inserted therein.

12. The device for holding a fastener of claim 1 wherein said device is made of material selected from a group consisting of metal, plastic, fiberglass, glass, ceramic and combinations thereof.

13. The device for holding a fastener of claim 12 wherein said device is made of metal.

14. The device for holding a fastener of claim 13 further wherein said device includes insulative plastic covering.

15. The device for holding a fastener of claim 1 wherein said gripping fingers are formed of flat stock material.

16. The device for holding a fastener of claim 1 wherein said gripping fingers are formed of round wire stock material.

17. The device for holding a fastener of claim 13 wherein a pair of gripping fingers and its spring are all formed of a single wire.

18. The device for holding a fastener of claim 1 wherein said elongated member is at least partially hollow and wherein at least one of said first pair of gripping fingers and said second pair of gripping fingers is partially within said elongated member and is slideably moveable away from and toward said elongated member.

19. The device for holding a fastener of claim 17 wherein said first pair of gripping fingers and said second pair of gripping fingers are each partially within said elongated member and are slideably moveable away from and toward said elongated member.

20. The device for holding a fastener of claim 19 wherein each of said first pair of gripping fingers and said second pair of gripping fingers have biasing springs establishing by a U-shaped member having a first end connected to a gripping finger and a second end connected to a different gripping finger.

* * * * *